US006319021B1

(12) United States Patent
Billman

(10) Patent No.: US 6,319,021 B1
(45) Date of Patent: Nov. 20, 2001

(54) POWER CONNECTOR PROVIDING IMPROVED PERFORMANCE

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/741,930

(22) Filed: Dec. 19, 2000

(51) Int. Cl.[7] ..... H01R 12/00
(52) U.S. Cl. ..... 439/78
(58) Field of Search ..... 439/78, 80, 81, 439/751

(56) References Cited

U.S. PATENT DOCUMENTS 4,749,357 * 6/1988 Foley ..... 439/80
5,055,055 * 10/1991 Bakker ..... 439/78
5,145,408 * 9/1992 Houtteman et al. ..... 439/581
5,984,696 * 11/1999 Lee ..... 439/79

* cited by examiner

*Primary Examiner*—Tulsidas Patel
(74) *Attorney, Agent, or Firm*—Wei Te Chung

(57) ABSTRACT

A power connector (1) comprises a conductive main body (10), a dielectric shell (50), a metallic pin (30) with knurls (332) and a number of metal terminals (40) secured in the main body. The main body defines a longitudinally extending passage (13), two rows of first and second passageways (152, 162) and two channels (110) at lateral sides thereof. Each channel extends toward the passage and communicates with the passageways. Lower portions of the second passageways communicate with a slit (164) defined from a bottom surface (102) of the main body. Each terminal forms a retention portion (41) at which the terminals are interconnected, a mating portion (42) providing an inwardly projecting stem (423), and a soldering portion (43). The retention portions of the terminals of the same row are received in the same slit and form a plurality of projections (412) abutting against an outer side of the slit. The stems of the mating portions inwardly project into the channels, whereby the stems tightly abut against an abutting surface (105) of the main body.

17 Claims, 8 Drawing Sheets

POWER CONNECTOR PROVIDING IMPROVED PERFORMANCE

BACKGROUND OF THE INVENTION

1. Field of the Invention

The present invention relates to an electrical connector, and particularly to a power connector which can establish a reliable connection between a pin and terminals thereof.

2. Brief Description of the Prior Art

U.S. Pat. No. 5,055,055, shown in FIG. 7, discloses a conventional power connector 200. The power connector 200 comprises a conductive body 217, a dielectric shell 215 surrounding the conductive body 217, a plurality of contacts 220, a metal band 216, and a metallic pin 218 retained in the conductive body 217.

A passage 222 longitudinally extends through the conductive body 217 for receiving the metal band 216. The metal band 216 surrounds and inwardly presses against a portion of the pin 218, which, together with the metal band 216, is received in the passage 222. Since the metal band 216 is resilient, the pin 218 is allowed to float within the metal band 216. After a large number of insert/withdraw cycles, the resilience of the metal band 216 will decrease. Accordingly, the pin 218 will float in a larger range than the designed range, particularly when the connector 200 is under conditions of vibration.

U.S. Pat. No. 5,807,120 discloses another conventional power connector 300 as shown in FIGS. 8 and 9. The connector 300 provides an insulative shell 314, a dielectric alignment member 318, a metal band 316, and an arcuate conductive strip 322 integral with a plurality of soldering tails 317 extending from a lower portion of lateral sides of the conductive strip 322 for insertion into a printed circuit board (not shown). The metal band 316 gradually narrows from opposite outer ends 316*a* to a middle portion thereof. The arcuate conductive strip 322 receives and connects with the metal band 316 within which a metallic pin (not shown) is inserted, for establishing an electrical connection between the metallic pin and the printed circuit board. FIG. 9 shows a partially assembled view of the conventional power connector 300. An inner wall 314*a* of the shell 314 downwardly presses against a top portion of the arcuate conductive strip 322 and a middle portion 318*a* of the alignment member 318, located between the two rows of soldering tails 317, upwardly abuts against a bottom portion of the metal band 316. By such design, the arcuate conductive strip 322 electrically contacts with the metal band 316 at positions of upper portions of the ends 316*a* of the metal band 316. The contact area of the upper portions, i.e.the opposite ends 316*a,* is not large enough for a power connector, which requires large contact area for transmitting current.

Hence, an improved electrical connector is required to overcome the disadvantages of the prior art.

BRIEF SUMMARY OF THE INVENTION

A first object of the present invention is to provide a power connector which has a conductive pin reliably mounted in a conductive body of the connector;

A second object of the present invention is to provide a power connector which has a plurality of terminals offering large contact area at which the terminals electrically connect with the conductive body.

To achieve the above-mentioned objects, a connector in accordance with the present invention includes a conductive main body, a dielectric shell surrounding the main body, a metal pin extending through the main body and protruding from the shell, and two rows of terminals secured at lateral sides of the main body.

The main body defines a longitudinally extending channel to form upper and lower walls in each lateral side thereof. A plurality of first and second passageways are respectively defined in the upper and lower walls. The first and second passageways extend perpendicularly to a corresponding channel and are aligned in a one-to-one manner.

The terminals of each row interconnect with each other at retention portions thereof and are contained substantially in a plane, except for stems and projections of the terminals, which project from the plane inwardly and outwardly, respectively. The terminals are received in the corresponding passageways in such a way that each stem projects inward into the corresponding channel and abuts against an abutting surface of the main body. The projections each tightly abut against an outward side of the corresponding passageway, thereby forcing the stem to reliably press against the main body and enlarging the contact area between the terminals and the main body.

The pin forms knurls around a rear member thereof for an interferential engagement with a longitudinal passage of the main body. Thereby, the pin is reliably fixed in the passage of the main body.

Other objects, advantages and novel features of the present invention will become more apparent from the following detailed description of the present embodiment when taken in conjunction with the accompanying drawings.

DETAILED DESCRIPTION OF THE INVENTION

Figure 1:
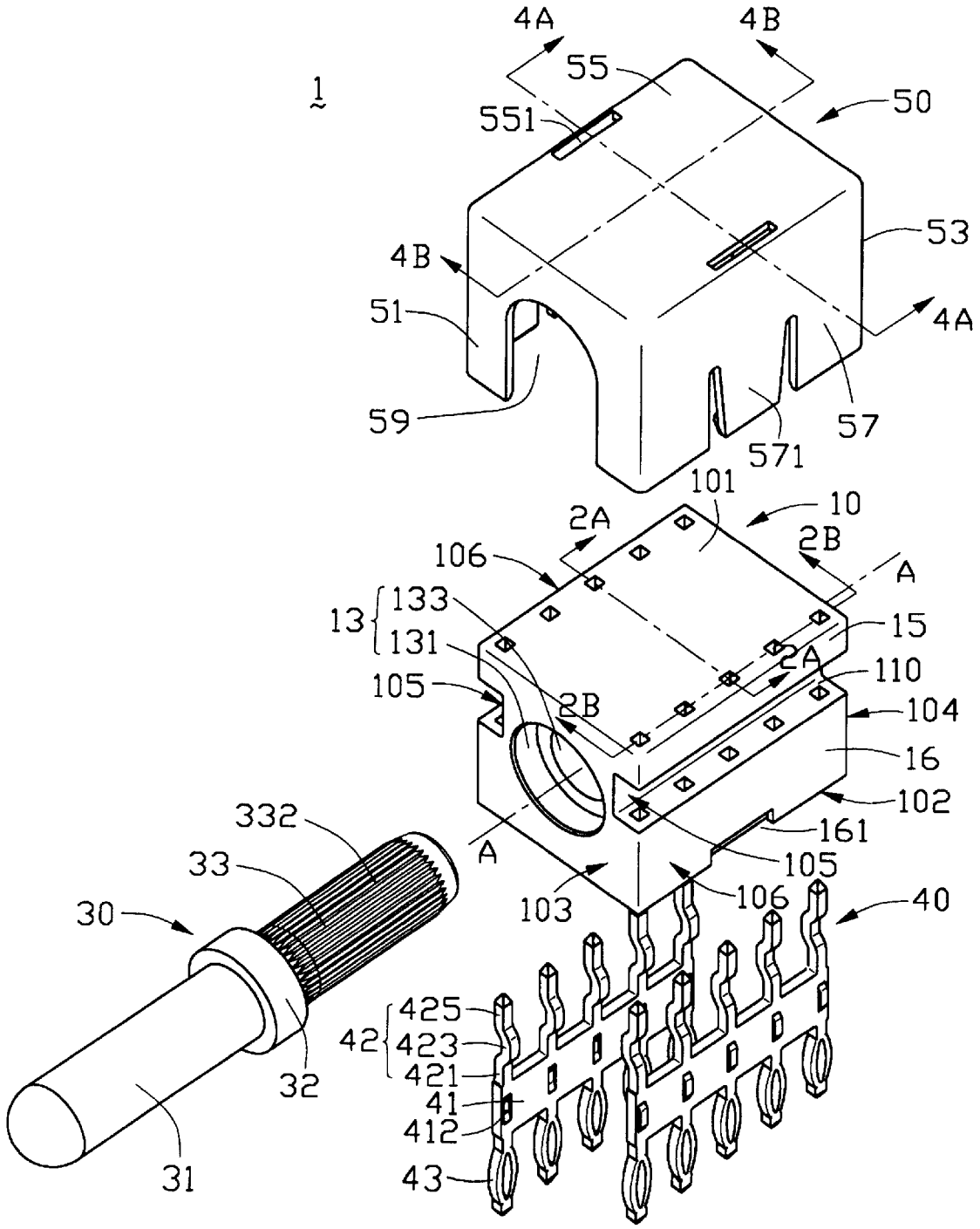
FIG. 1 is an exploded view of a power connector in accordance with the present invention.

Referring to FIG. 1, a power connector 1 of the present invention comprises a conductive main body 10, a metallic pin 30 secured in the main body 10, a plurality of terminals 40 mounted in the main body 10, and a dielectric shell 50 surrounding the main body 10.

Figure 2A:
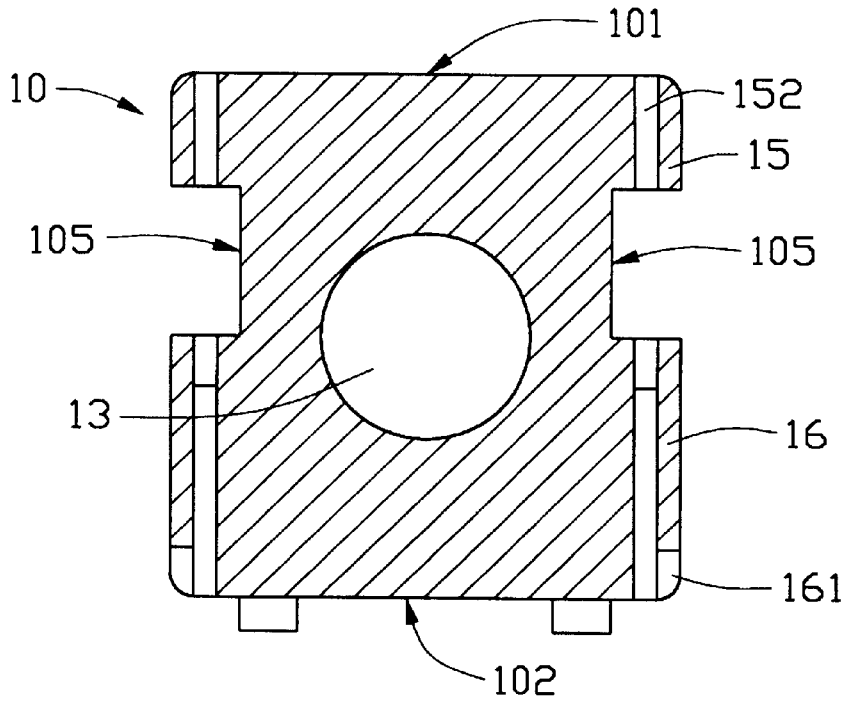
FIG. 2A is a cross-sectional view taken along line 2A—2A of FIG. 1.

The main body 10 is substantially rectangular and is symmetrical about a vertical plane including a longitudinal axis A. The main body 10 has a top surface 101, a bottom surface 102 opposite the top surface 101, a front surface 103, a rear surface 104 opposite the front surface 103, and lateral side surfaces 106. Further referring to FIG. 2A, a passage 13 extends from the front surface 103 to the rear surface 104 along the longitudinal axis A and is cylinder-shaped for receiving the metallic pin 30. The passage 13 is divided into a front section 131 and a rear section 133, the radius of the front section 131 being greater than that of the rear section 133.

Figure 2B:
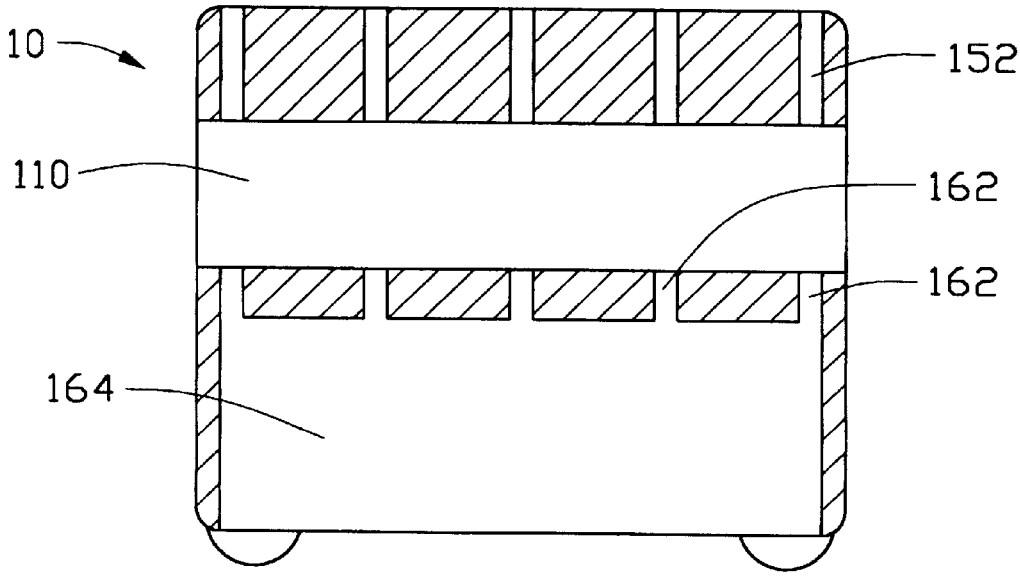
FIG. 2B is a cross-sectional view taken along line 2B—2B of FIG. 1.

The main body 10 defines a longitudinal channel 110 in each lateral side thereof extending from the corresponding side surface 106 toward the passage 13. An inner side of each channel 110 offers an outward facing abutting surface 105 which extends from the front surface 103 to the rear surface 104 and parallels the vertical plane including the symmetric axis A. Each channel 110 divides the lateral side of the main body into an upper wall 15 and a lower wall 16. Viewed from FIG. 2B, each upper wall 15 defines five first passageways 152 perpendicular to the channel 110 and each lower wall 16 defines five second passageways 162 in alignment with corresponding first passageways 152. Each lower wall 16 further provides a cutout 161 at a middle of a bottom side thereof. Each passageway 152, 162 communicates with a corresponding channel 110. The second passageways 162 of a same side of the main body 10 extend from the channel 110 downward and, at a lower end, communicate with a slit 164 defined from the bottom surface 102 of the main body 10 upward through a corresponding lower wall 16. The preferred embodiment is adapted for a 10-pin dual-in-line package but can also be designed for other configurations such as an 8-pin configuration.

The pin 30 is configured to be accommodated in the passage 13 of the main body 10. The pin 30 consists of a front member 31, a rear member 33, and an intermediate member 32 connecting the front member 31 with the rear member 33. The intermediate member 32 has a larger diameter than the front member 31 or the rear member 33. The rear member 33 integrally forms knurls 332 for an interferential engagement with the second section 133 of the passage 13 of the main body 10. The knurls 332 are evenly distributed around a peripheral surface of the rear member 33 and extend longitudinally from a position near the intermediate member 32 to a position adjacent a rear end of the rear member 33.

Figure 3:
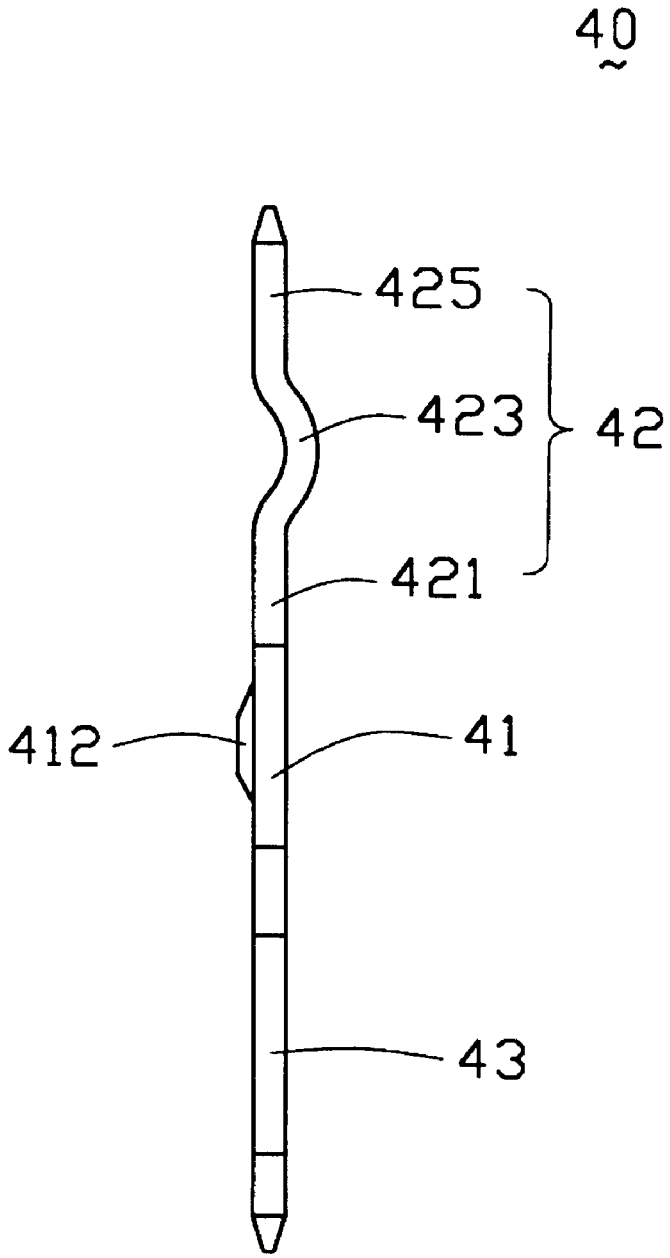
FIG. 3 is a side view of one row of the terminals of FIG. 1.

Referring to FIGS. 1 and 3, the terminals 40 are arranged in separated first and second rows. Each row of terminals contains five terminals 40 which are connected together and are substantially coplanar.

Each terminal 40 has an intermediate retention portion 41 between which the terminals 40 are interconnected, a mating portion 42 upwardly extending from the retention portion 41, and a press-fit soldering portion 43 depending from the retention portion 41 for soldering into a printed circuit board (not shown) on which the power connector is mounted. The retention portion 41 is wider than the mating portion 42 and the soldering portion 43. An outwardly projecting projection 412 is stamped from the retention portion 41 and is aligned with the mating portion 42 and the soldering portion 43. The mating portion 42 includes a root 421 projecting upwardly from an upper edge of the retention portion 41, a stem 423 continuing upward from the root 421, and a tip 425 extending upwardly from the stem 423. The stem 423 curves sidewardly to reliably abut with the main body 10.

Figure 4A:
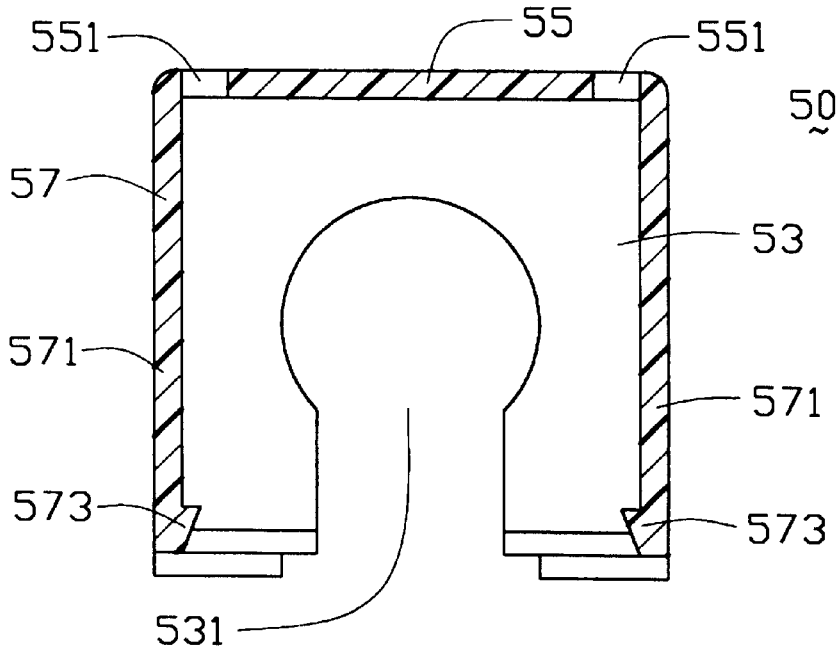
FIG. 4A is a cross-sectional view taken along line 4A—4A of FIG. 1.
Figure 4B:
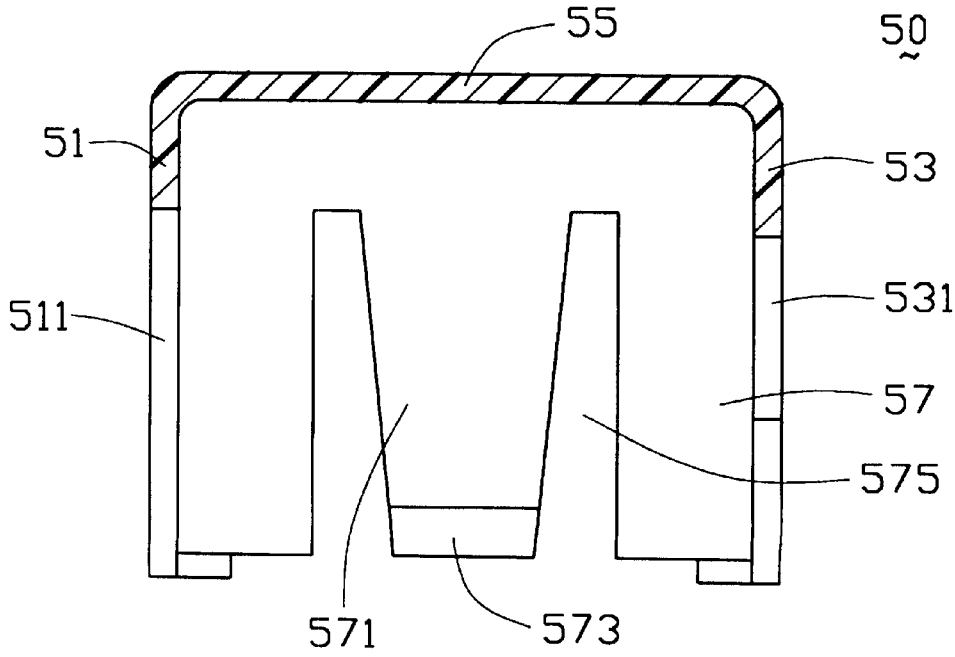
FIG. 4B is a cross-sectional view taken along line 4B—4B of FIG. 1.

Further referring to FIGS. 4A and 4B, the shell 50 is box-like and defines a front wall 51, a rear wall 53 opposite the front wall 51, a top wall 55, a pair of sidewalls 57, and a cavity 59 surrounded by the walls. A first opening 511 defined in the front wall 51 extends upwardly from a bottom edge of the front wall 51. The rear wall 53 also defines a second opening 531, in alignment with the first opening 511, extending upwardly from a bottom edge of the rear wall 53. Both of the openings 511, 531 communicate with the cavity 59. The top wall 55 provides a pair of splits 551 at lateral sides thereof for facilitating an assembly of the shell 50 to the main body 10. A pair of symmetrically positioned latches 571 is provided in the sidewalls 57 corresponding to the cutouts 161 of the main body 10. Each latch 571 extends from an upper portion of the corresponding sidewall 57 to the bottom edge of the sidewall 57 and is separated from a front portion and a rear portion of the sidewall 57 by a pair of gaps 575. Therefore, the latches 571 can resiliently, laterally rotate relative to the corresponding sidewalls 57. Each latch 571 provides an inwardly projecting barb 573 at a lowermost end thereof.

Figure 5:
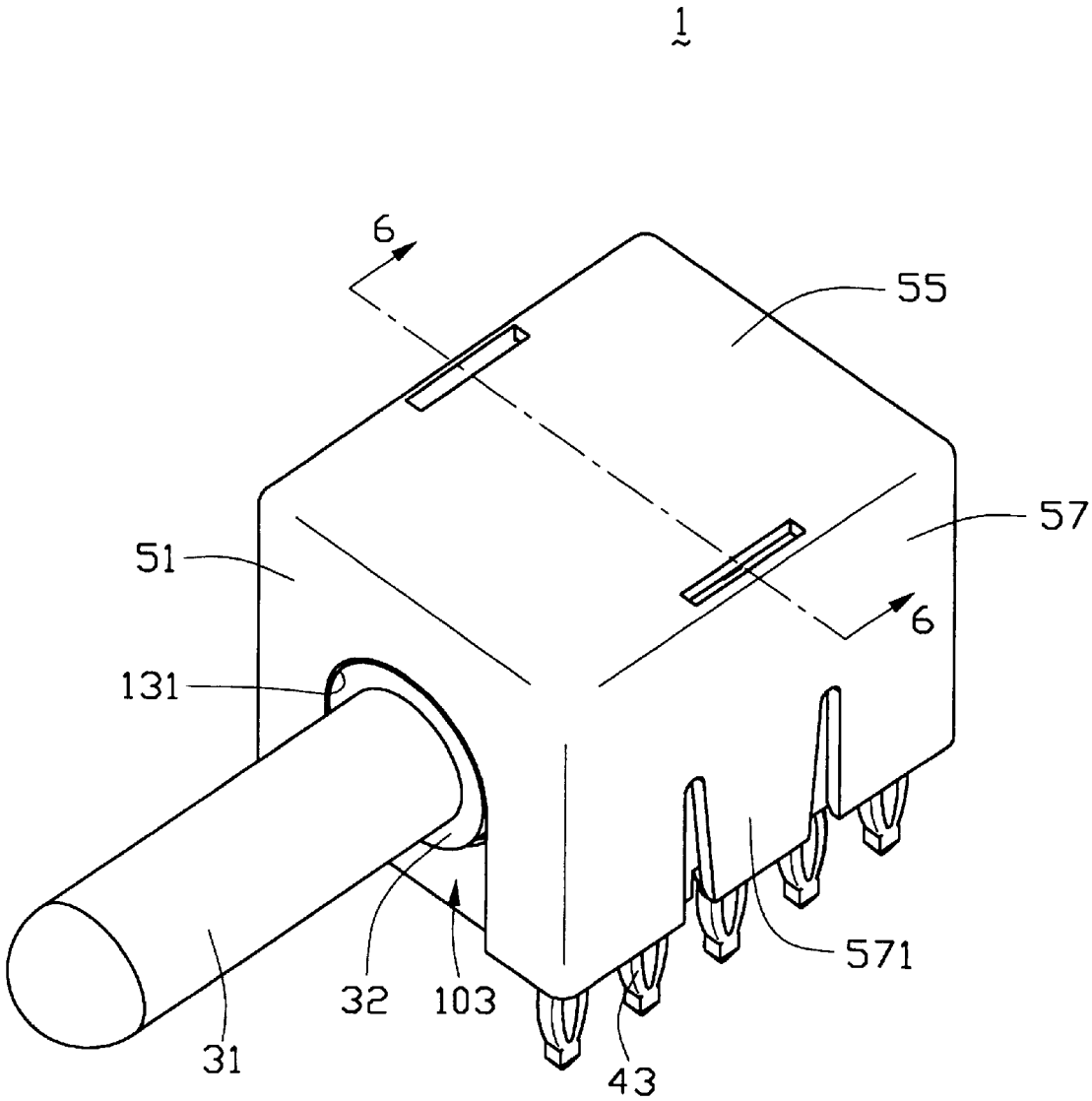
FIG. 5 is an assembled view of the power connector of FIG. 1.
Figure 6:
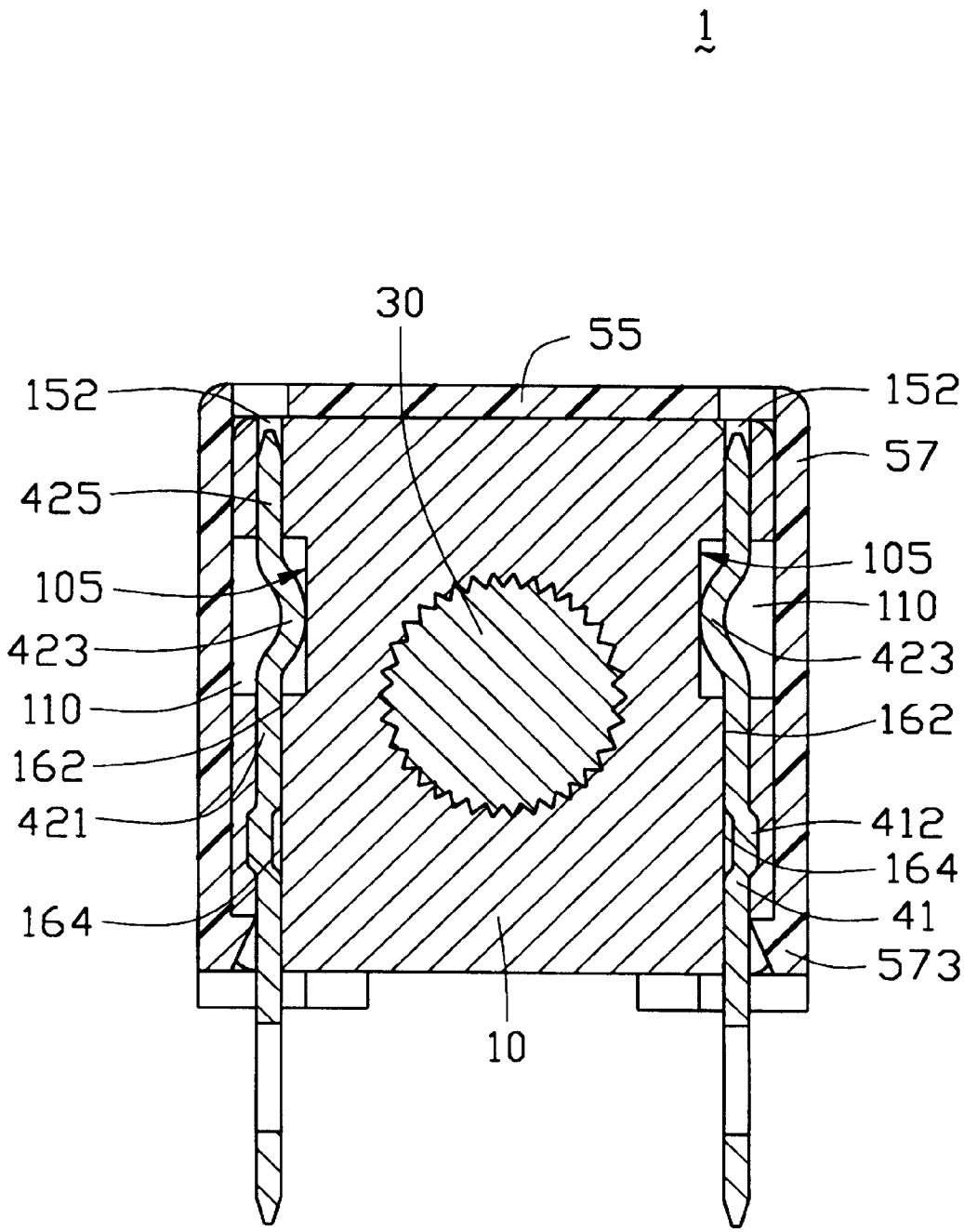
FIG. 6 is a cross-sectional view of the power connector taken along line 6—6 of FIG. 5.
Figure 7:
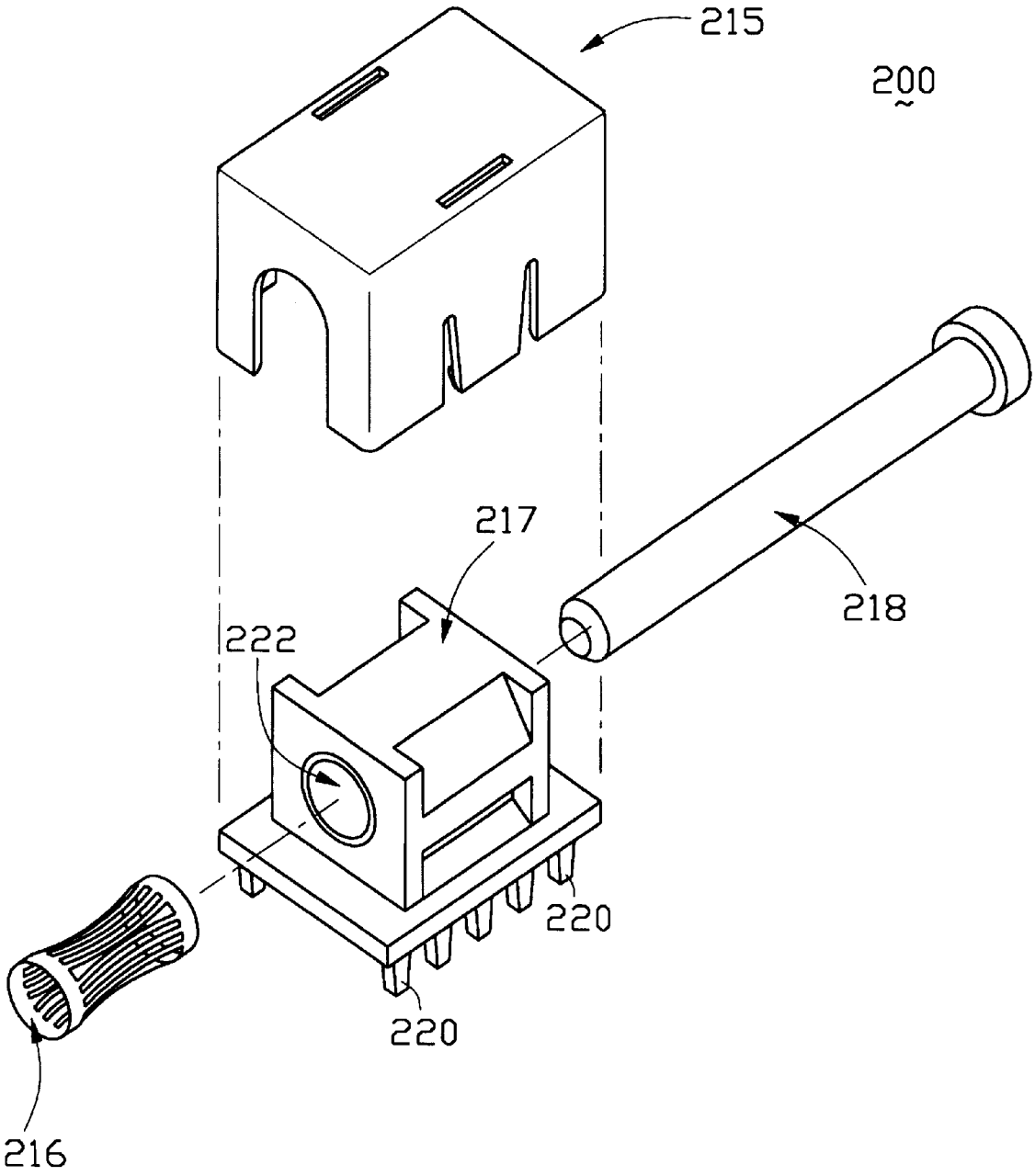
FIG. 7 (PRIOR ART)
FIG. 7 is an exploded view of a conventional power connector.
Figure 8:
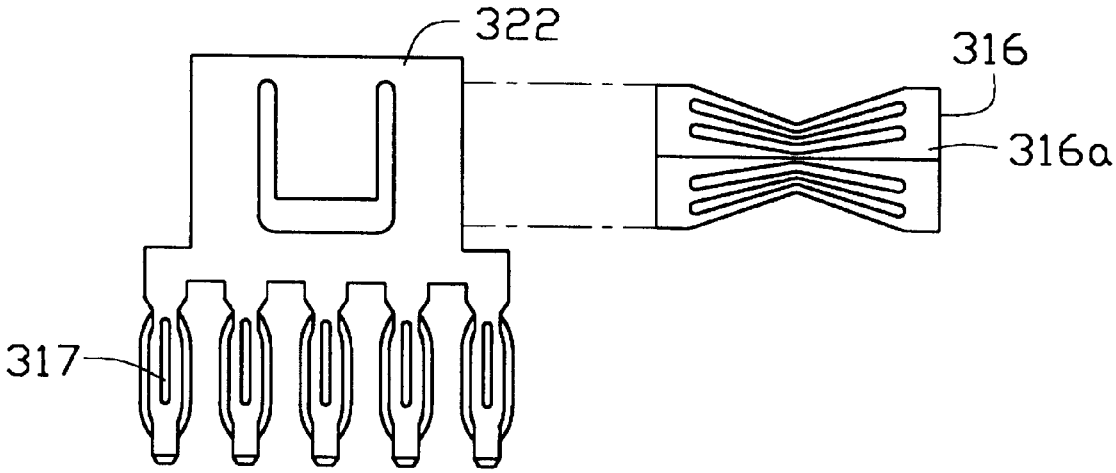
FIG. 8 (PRIOR ART)
FIG. 8 is an exploded view of two components of another conventional power connector.
Figure 9:
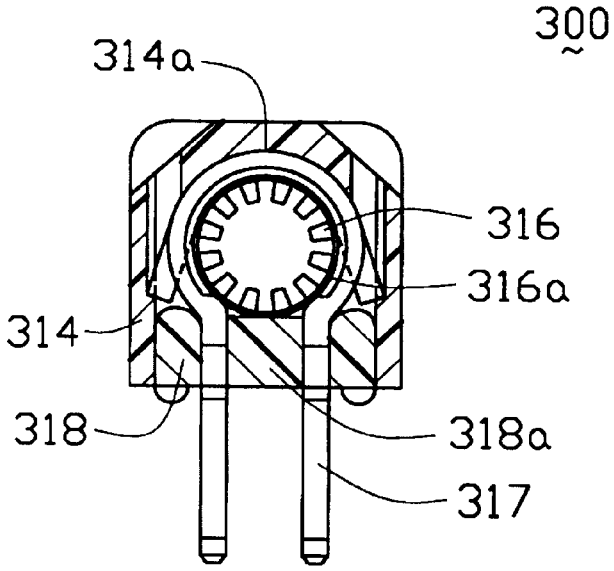
FIG. 9 (PRIOR ART)
FIG. 9 is a cross-sectional view of the complete and assembled power connector of FIG. 8.

FIGS. 5 and 6 show an assembled power connector 1. The pin 30 is inserted into the passage 13 along the symmetric axis A such that the front member 31 thereof protrudes from the front surface 103 of the main body 10, the intermediate member 32 is fitted in the front section 131 of the passage 13, and the rear member 33 is received in the rear section 133 of the passage 13. With the help of the knurls 332 of the rear member 33, the rear member 33 interferentially engages with the rear section 133, thereby securing the pin 30 in the main body 10.

The rows of terminals 40 are pushed into corresponding passageways 162, 152 from the bottom surface 102 of the main body 10, in a mirror-image arrangement. Note that at the time of insertion into the main body 10, no stems 423 have yet been bent into the terminals 40. Upon insertion, the retention portions 41 of the terminals 40 of the same row reside in the corresponding slit 164 of the main body 10 and the mating portions 42 extend upwardly into the corresponding second and first passageways 162, 152. The soldering portions 43 are exposed from the bottom surface 102 of the main body 10. The projections 412 of the retention portions 41 press against outer sides of the corresponding slits 164, thereby forcing the mating portions 42 to tightly abut against inner sides of the corresponding first and second passageways 152, 162 and positioning each terminal 40 in position.

Subsequently, portions of the mating portions 42 exposed in the channels 110 are simultaneously stamped inwardly to form the stems 423 to abut against the abutting surface 105 and to prevent the terminals 40 from moving up-and-down within the passageways 152, 162. The mating portion 42 of each terminal 40 is secured in the main body 10 such that the root 421 is received in the second passageway 162, the stem 423 is received in the channel 110 and abuts against the abutting surface 105 of the main body, and the tip 425 is received in the first passageway 152. The tips 425 of the terminals 40 do not protrude from the top surface 101 of the main body. Therefore, the tips 425 are in no danger of being deformed by the shell 50 which covers the main body 10.

Then the shell 50 is pressed onto the main body 10 such that the barbs 573 of the latches 571 extend into the corresponding cutouts 161to attach the shell 50 to the main body 10.

It is a feature of the power connector 1 that the terminals 40 contact the main body 10 not only via the projections 412 of the retention portions 41, but also via the stems 423 of the mating portions 42, thereby enlarging a contacting surface between the terminals 40 and the main body 10.

In the preferred embodiment, the projection 412 is aligned with the mating portion 42 and the soldering portion 43 of each terminal 40. This alignment of the projections 412 with the corresponding mating portions 42 and soldering portions 43 enables the row of terminals 40 to contain any numbers of terminals. Therefore, a row of terminals 40 can be cut from a carrier to have any number of terminals, for example, five terminals in each row, which enhances the flexibility of the manufacturing of the power connector. Alternatively, the projections 412 may not align with the corresponding mating portions 42 and soldering portions 43, sacrificing the benefit of manufacturing flexibility.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a printed circuit board, comprising:

a dielectric shell defining a cavity and an opening in a front wall thereof, the opening communicating with the cavity;

a conductive main body received in the cavity and defining a passage aligning with the opening, the main body further defining a plurality of passageways at lateral sides of the passage and a slit at each lateral side of the passage extending upwardly from a bottom surface thereof and communicating with the plurality of passageways;

a conductive pin accommodated in the passage and engaging with the main body, a front member of the pin protruding through the opening; and a plurality of metallic terminals received in the corresponding passageways and engaging with the main body, each of the terminals having a retention portion between which the terminals are interconnected, a mating portion upwardly extending from the retention portion, and a soldering portion depending from the retention portion for inserting into the printed circuit board, the retention portions being received within a corresponding slit and mechanically and electrically connecting with the main body.

2. The electrical connector as claimed in claim 1, wherein the retention portions of the terminals each form a projection extending in a direction away from the passage and abutting against an outer side of a corresponding slit.

3. The electrical connector as claimed in claim 2, wherein the passageways of each row include a plurality of first and second passageways, each first passageway being in alignment with a corresponding second passageway.

4. The electrical connector as claimed in claim 3, wherein the main body further defines a pair of channels in opposite lateral sides extending parallel to the passage and extending perpendicularly to the passageways at the same side of the passage and being in communication with the first passageways and the second passageways of the same side of the passage.

5. The electrical connector as claimed in claim 4, wherein each of the terminals received in the passageways at the same side of the passage is separated from the corresponding one of the terminals received in the passageways at the opposite side of the passage, thereby establishing different electrical connections between the connector and the printed circuit board.

6. An electrical connector for mounting on a printed circuit board, comprising:

a dielectric shell defining a cavity and an opening in a front wall thereof, the opening communicating with the cavity;

a conductive main body received in the cavity and defining a passage in alignment with the opening, a row of passageways being defined in the main body at at least one lateral side of the passage, and a channel being defined in a side surface of the main body at the at least one lateral side of the passage, the channel being in communication with the row of passageways;

a conductive pin accommodated in the passage and having a front member protruding through the opening of the shell; and a row of terminals being received in the passageways, each of the terminals providing a curved contacting portion projecting from a corresponding passageway into a corresponding channel toward the passage for abutting against the main body.

7. The electrical connector as claimed in claim 6, wherein the channel extends from a side surface of the main body toward the passage and is substantially perpendicularly to the passageways.

8. The electrical connector as claimed in claim 6, wherein each of the passageways includes a first passageway and a second passageway aligned with the first passageway, and wherein the channel communicates with the first passageway and with the second passageway.

9. The electrical connector as claimed in claim 8, wherein each of the terminals includes a mating portion accommodated within a corresponding passageway, a retention portion connecting with the mating portion for retaining the terminal in position, and a soldering portion extending from the retention portion for soldering to the printed circuit board.

10. The electrical connector as claimed in claim 9, wherein the mating portion comprises a lower portion, an upper portion, and the contacting portion connecting the lower portion with the upper portion, and wherein the lower portion is received in the second passageway, and the upper portion is received in the first passageway.

11. The electrical connector as claimed in claim 10, wherein the contacting portion is formed in the channel subsequent to insertion of each terminal into the main body.

12. The electrical connector as claimed in claim 10, wherein the main body defines a slit extending upward from a bottom surface of the main body at the at least one lateral side of the passage, and the slit communicates with the second passageways of the row of passageways at the at least one lateral side of the passage.

13. The electrical connector as claimed in claim 12, wherein the retention portions of the row of terminals are interconnected in a plane and are received in the slit.

14. The electrical connector as claimed in claim 13, wherein the retention portions of the row of terminals form a plurality of projections, the terminals being assembled into the main body such that the projections abut against a side of the slit away from the passage, thereby forcing the terminals to tightly abut against inner sides of the corresponding passageways and forcing the contacting portions to tightly abut against an inner side of the channel.

15. An electrical connector comprising:

a dielectric shell defining a cavity;

a conductive main body received within said cavity;

a plurality of passageways defined in the main body in a vertical direction;

a channel extending horizontally and intersecting the passageways;

a slit extending upwardly from a bottom face of the main body in communication with the passageways;

a plurality of terminals disposed in the main body, intermediate portions of said terminals being connected together to be received within the slit, each of said terminals including a mating portion above the corresponding intermediate portion, said mating portion received within the corresponding passageway with a stem received within the channel; wherein said stem is curvedly deformed in the channel only after the terminal has been completely received in the passageway so as to prevent withdrawal of the terminal from the passageway.

16. An electrical connector for mounting on a printed circuit board, comprising:

a dielectric shell defining a cavity and an opening in a front wall thereof, the opening communicating with the cavity;

a conductive main body received in the cavity and defining a passage in alignment with the opening, a row of passageways being defined in the main body at at least one lateral side of the passage, and a channel being defined in a side surface of the main body at the at least one lateral side of the passage, each of the passageways including a first passageway and a second passageway and the channel communicating the first passageways with the second passageways;

a conductive pin accommodated in the passage and having a front member protruding through the opening of the shell; and a row of terminals being received in the passageways, each of the terminals having a mating portion, a retention portion, and a soldering portion for soldering to the printed circuit board, the mating portion comprising a lower portion received in a corresponding second passageway, an upper portion received in a corresponding first passageway, and a contacting portion connecting the lower portion with the upper portion and projecting from a corresponding passageway into a corresponding channel, wherein the main body defines a slit extending upward from a bottom surface of the main body at the at least one lateral side of the passage, and the slit communicates with the second passageways of the row of passageways at the at least one lateral side of the passage, the retention portions of the row of terminals being interconnected in a plane and being received in the slit, the retention portions of the row of terminals forming a plurality of projections, the terminals being assembled into the main body such that the projections abut against a side of the slit away from the passage, thereby forcing the terminals to tightly abut against inner sides of the corresponding passageways and forcing the contacting portions to tightly abut against an inner side of the channel.

17. The electrical connector as claimed in claim 16, wherein each of the projections aligns with the mating portion and soldering portion of the corresponding terminal.

* * * * *